United States Patent [19]

Orrell et al.

[11] 4,176,047

[45] Nov. 27, 1979

[54] REMOVAL OF ORGANIC COMPOUNDS FROM COKER GASOLINE

[75] Inventors: Derrell D. Orrell; Melvin M. McFeeters, both of Ponca City, Okla.

[73] Assignee: Continental Oil Company, Ponca City, Okla.

[21] Appl. No.: 894,978

[22] Filed: Apr. 10, 1978

[51] Int. Cl.[2] ..... C10G 37/00

[52] U.S. Cl. ..... 208/51; 208/53; 208/131; 208/299; 208/302

[58] Field of Search ..... 208/51, 53, 211, 299, 208/302

[56] References Cited

U.S. PATENT DOCUMENTS

| | | | |
|---|---|---|---|
| 2,127,654 | 8/1938 | Stratford | 208/299 |
| 3,019,180 | 1/1962 | Schreiner et al. | 208/51 |
| 3,518,182 | 6/1970 | Paterson | 208/51 |
| 3,700,587 | 10/1972 | Hyde | 208/131 |
| 3,954,603 | 5/1976 | Curtin | 208/253 |

*Primary Examiner*—Herbert Levine

*Attorney, Agent, or Firm*—Richard W. Collins

[57] ABSTRACT

A gasoline boiling range hydrocarbon stream obtained by fractionation of overhead vapors from a delayed coker is treated for removal of organic silicon compounds prior to being processed in a desulfurizer and catalytic reformer. The stream is treated by a bed of material such as alumina, activated alumina or spent alumina-based desulfurizer catalyst at elevated temperature to reduce the level of organic silicon compounds. The organic silicon compounds, if not removed, are detrimental to desulfurizer and reformer catalysts. The organic silicon compounds are conventionally added to a delayed coker to control foaming.

4 Claims, 1 Drawing Figure

REMOVAL OF ORGANIC COMPOUNDS FROM COKER GASOLINE

BACKGROUND OF THE INVENTION

This invention relates to processing of hydrocarbon streams in a petroleum refinery, and more particularly to production of a high octane motor fuel.

Many petroleum refineries utilize a delayed coking unit to process residual oils. In delayed coking, overhead vapors from the coking drum pass to a fractionator where various fractions are separated. One of the fractions is a gasoline boiling range stream. This stream, commonly referred to as coker gasoline, is generally a relatively low octane stream, unsuitable for use as an automotive fuel without upgrading. With the limitations on octane improving additives imposed by environmental concerns, it has become desirable to process coker gasoline in an octane improving unit such as a catalytic reformer. Sulfur compounds in coker gasoline are detrimental to catalytic reforming catalysts, and accordingly it has become commonplace to treat coker gasoline in a catalytic desulfurizer prior to processing it in a catalytic reformer. The above discussed steps of delayed coking, desulfurization and reforming are well developed commercial processes which are widely used in the refining industry, and do not constitute a part of this invention.

In the delayed coking process, quantities of foam are often produced which are undesirable as the foam diminishes the efficiency of the delayed coking process. It is customary, as described in U.S. Pat. No. 3,700,587, to add silicone defoamers, for example polydimethyl siloxanes, to delayed cokers to control the undesirable foaming. These defoamers result in an undesirable level of organic silicon in the coker gasoline fractionated from the coker overhead vapors. It is believed that the organic silicon compounds inactivate the catalyst used for desulfurization of the coker gasoline, such that it is desirable to remove the organic silicon compounds from coker gasoline prior to contacting a catalytic material with the contaminated coker gasoline.

The use of activated alumina and related materials to treat hydrocarbon streams is described in U.S. Pat. Nos. 2,403,088; 2,413,868 and 2,890,257. U.S. Pat. Nos. 3,919,077 and 3,954,603 describe the use of guard beds of material to remove catalyst poisoning contaminants from hydrocarbon streams. However, none of the above-noted references are directed to the problem of removal of organic silicon from coker gasoline prior to upgrading of the coker gasoline by a catalytic operation.

SUMMARY OF THE INVENTION

According to the present invention, coker gasoline is treated by a material capable of removing organix silicon compounds prior to processing the coker gasoline in a catalytic desulfurizer and/or a catalytic reformer. The material used to remove the organic silicon compounds may be alumina, activated alumina or a spent alumina-based desulfurizer catalyst. These materials have been found to be effective in removing organic compounds from coker gasoline, particularly at temperatures of about 90° C. or higher. The invention contemplates placing a vessel containing one of the above-noted materials in the flow line between a coker fractionator and a reformer-desulfurizer.

It is accordingly an object of the present invention to remove organic silicon compounds from coker gasoline prior to processing the coker gasoline in a catalytic desulfurizer or a reformer.

BRIEF DESCRIPTION OF THE DRAWING

The drawing is a flow diagram illustrating the process in accordance with the invention.

DESCRIPTION OF THE PREFERRED EMBODIMENTS

Figure 1:
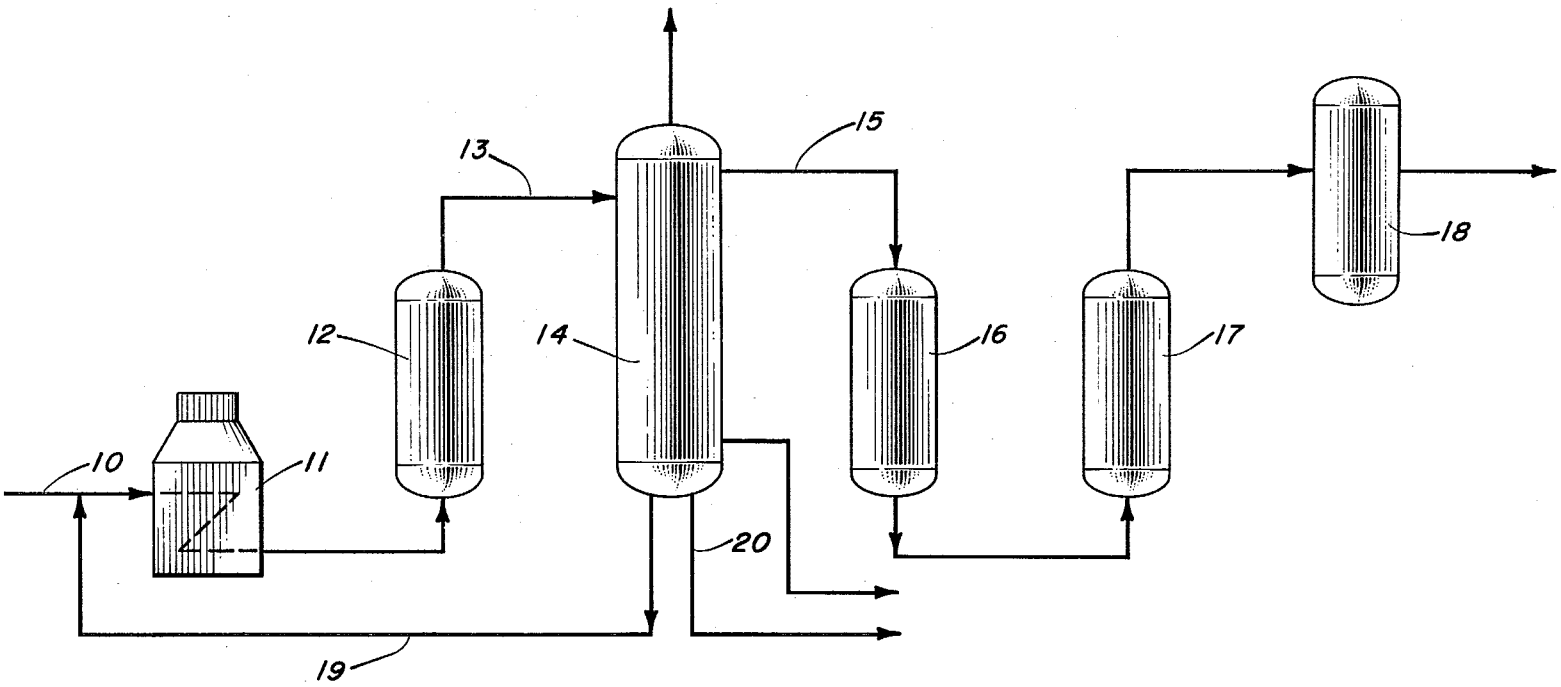

The process in accordance with the invention will be described with reference to the flow diagram of the drawing.

Coker feedstock from line 10 is fed to a coker furnace 11 where it is heated to coking temperature and then fed to delayed coking drum 12. Overhead vapors from coke drum 12 are passed from line 13 to fractionator 14. Fractionator 14 separates the material into several components including a gasoline boiling range stream taken off at line 15. Typically, the bottom fraction from fractionator 14 is returned to coker furnace 11 by line 19 as recycle to the coking process as shown in the drawing. The coker gasoline from line 15 passes to a vessel 16 containing a material capable of removing organic silicon compounds from the coker gasoline. The clean coker gasoline from vessel 16 then passes to a catalytic desulfurization unit 17 where any sulfur in the stream is removed. The low sulfur gasoline stream from desulfurizer 17 then passes to a catalytic reforming unit 18 where it is upgraded so that it will be suitable for use as an automotive fuel. As noted previously, the delayed coking operation, the coker fractionator, the coker gasoline desulfurizer and the reformer are all conventional technology not constituting a part of the invention.

It has been found that alumina, activated alumina and spent alumina-supported catalysts are effective in reducing the amount of organic silicon in coker gasoline in accordance with this invention. Bauxite ore was found to be effective to some extent, but was considerably less efficient than the above-noted materials. Caustic and hydrochloric acid extractions were found to be ineffective, as were other clay and molecular sieve materials. It was further found that a temperature of at least 90° C. was required for effective removal of organic silicon compounds, and a temperature of from 120°–150° C. is preferred for optimum efficiency.

The most desirable material for use in the process of this invention is a spent alumia-based desulfurization catalyst which is no longer effective for removing sulfur from a hydrocarbon stream. Rather than disposing of or regenerating this spent desulfurizer catalyst, it has been found that it can be used very effectively for removing organic silicon compounds. A particularly preferred spent desulfurizer catalyst is an alumina-based cobalt-molybdenum oxide catalyst comprising about 14 percent molybdenum oxide and about 4 percent cobaltic oxide on an aluminum oxide support. Catalyst particles which are cylindrical in shape and have a diameter of approximately one millimeter and a length of about ten millimeters are particularly suitable.

The following examples demonstrate the utility of this invention.

EXAMPLE 1

Coker gasoline containing 5 ppm silicon was passed through a 2.5×5.0 centimeter column containing a spent alumia-supported cobalt-molybdenum oxide desulfurizer catalyst at temperatures of 19° C. and 38° C. with no effect on silicon concentration. The same column at a temperature of 93° C. lowered the silicon content from 5 ppm to 2 ppm. Increasing the column depth to 12.7 centimeters and maintaining a temperature of 93° C. removed essentially all of the silicon from 250 milliliters of coker gasoline.

EXAMPLE 2

The same column as used in Example 1, containing 5 centimeters of activated alumina pellets, showed no removal of silicon from 250 milliliters of coker gasoline at 19° C. Increasing the column temperature to 93° C. resulted in a reduction of silicon from 5 to 3 ppm.

For optimum efficiency in removing organic silicon compounds from coker gasoline, a temperature of from 120°–150° C. is preferred.

A conventional catalytic desulfurizer could be used to remove organic silicon compounds from coker gasoline prior to processing the gasoline in a reformer, but the organic silicon compounds have been found to be detrimental to the desulfurizer catalyst, decreasing its effectiveness as a sulfur removing agent. It is fortunate that spent desulfurizer catalyst, which prior to this invention had no particular utility, can be utilized to remove organic silicon compounds in accordance with this invention.

The amount of material needed in accordance with the invention depends upon the amount of silicon in the coker gasoline and the amount of silicon which can be tolerated in downstream processes. In the case of a coker gasoline containing 5 ppm silicon, and in which 1 ppm silicon can be tolerated downstream, the amount of silicon-removing material required when operating at the preferred temperature range of from 120°–150° C. is about 0.25 cubic feet per barrel of coker gasoline. The volume of material used will determine the time interval between cycles. It will be appreciated that a multiple vessel arrangement adapted for sequential use of one of a plurality of vessels could be utilized, and it is even possible that piping be arranged, with a plurality of desulfurizer units, such that a spent desulfurizer vessel could be utilized as a silicon removing guard bed. Various modifications and arrangements of vessels and piping will be apparent to those skilled in the art.

We claim:

1. In a refinery process including a delayed coking operation in which organic silicon compounds are added to the coker feedstock to control foaming, and wherein a hydrocarbon stream in the gasoline boiling range obtained by fractionation of overhead vapors from the coking step is processed through a desulfurizer and then through a reformer unit, the improvement comprising:

passing said coker gasoline, prior to passing it through said desulfurizer, through a bed of spent desulfurization catalyst capable of removing a substantial portion of said organic silicon compounds.

2. The process of claim 1 wherein said bed of spent desulfurization catalyst is an aluminum oxide supported cobalt-molybdenum oxide catalyst.

3. The process of claim 1 wherein said bed of spent desulfurization catalyst is maintained at a temperature of at least 90° C.

4. The process of claim 1 wherein said bed of spent desulfurization catalyst is maintained at a temperature of from 120° to 150° C.

* * * * *